US005929408A

United States Patent [19]

Gutierrez et al.

[11] Patent Number: 5,929,408

[45] Date of Patent: Jul. 27, 1999

[54] COMPOSITIONS AND METHODS FOR ORE BENEFICIATION

[75] Inventors: Amaro Ruben Quiroz Gutierrez; Carlos Guillermo Torres Yañez, both of Santiago, Chile

[73] Assignee: Cytec Technology Corp., Wilmington, Del.

[21] Appl. No.: 08/721,177

[22] Filed: Sep. 26, 1996

[51] Int. Cl.[6] ..... B03D 1/02; B03D 1/012; B03D 1/014

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 2,861,687 | 5/1958 | Cordis | 209/98 |
| 3,214,018 | 10/1965 | Neal | 209/166 |
| 3,405,802 | 10/1968 | Preller et al. | 209/166 |
| 3,827,557 | 8/1974 | Fischer | 209/167 |
| 4,166,837 | 9/1979 | Gallacher et al. | 423/24 |
| 4,172,029 | 10/1979 | Hefner, Jr. | 209/166 |
| 4,255,395 | 3/1981 | Gallacher et al. | 423/24 |
| 4,308,133 | 12/1981 | Meyer | 209/166 |
| 4,309,282 | 1/1982 | Smith, Jr. et al. | 209/166 |
| 4,511,464 | 4/1985 | Bergman | 209/166 |
| 4,514,292 | 4/1985 | Burdick | 209/167 |
| 4,556,482 | 12/1985 | Nagaraj | 209/166 |
| 4,587,013 | 5/1986 | Nagaraj et al. | 209/167 |
| 4,595,493 | 6/1986 | Nagaraj | 209/166 |
| 4,605,519 | 8/1986 | Bergman | 558/234 |
| 4,618,461 | 10/1986 | Bergman et al. | 558/234 |
| 4,676,890 | 6/1987 | Kimpel et al. | 558/232 |
| 4,684,459 | 8/1987 | Klimpel et al. | 209/166 |
| 4,699,711 | 10/1987 | Bergman et al. | 209/166 |
| 4,702,822 | 10/1987 | Klimpel et al. | 209/166 |
| 4,732,688 | 3/1988 | Bryan et al. | 210/753 |
| 4,735,711 | 4/1988 | Klimpel et al. | 209/166 |
| 4,780,557 | 10/1988 | Sutherland et al. . | |
| 4,789,392 | 12/1988 | Klimpel et al. | 209/166 |
| 4,793,852 | 12/1988 | Harris et al. . | |
| 4,797,202 | 1/1989 | Klimpel et al. | 209/166 |
| 4,822,483 | 4/1989 | Klimpel et al. | 209/167 |
| 4,943,656 | 7/1990 | Gallacher et al. | 562/90 |
| 5,015,367 | 5/1991 | Klimpel et al. | 209/166 |
| 5,057,209 | 10/1991 | Klimpel et al. | 209/167 |
| 5,171,427 | 12/1992 | Klimpel et al. | 209/166 |
| 5,173,176 | 12/1992 | Klimpel et al. | 209/166 |

FOREIGN PATENT DOCUMENTS

| | | |
|---|---|---|
| WO92/11091 | 7/1992 | WIPO . |

*Primary Examiner*—Thomas M. Lithgow
*Attorney, Agent, or Firm*—Joseph J. Mallon

[57] ABSTRACT

Novel compositions comprised of a dialkyl aryl disulfonic acid and a collector different from the dialkyl aryl disulfonic acid are provided, said compositions being useful for beneficiation of ores. Novel methods for using compositions comprised of a dialkyl aryl disulfonic acid and a collector different from the dialkyl aryl disulfonic acid to beneficiate ores are also provided.

18 Claims, No Drawings

COMPOSITIONS AND METHODS FOR ORE BENEFICIATION

BACKGROUND OF THE INVENTION

This invention is related to the beneficiation of sulfide and precious metal ores, preferably by froth flotation.

Froth flotation is one of the most widely used processes for beneficiating ores containing valuable minerals; see e.g. "Flotation: Theory, Reagents and Ore Testing" by Ronald D. Crozier, Pergammon Press 1992; also "Surface Chemistry of Froth Flotation" by Jan Leja, Plenum Press, 1982. It is especially used for separating finely ground valuable minerals from their associated gangue or for separating valuable minerals from one another. In froth flotation, a froth or a foam is generally formed by introducing air into an aqueous slurry of the finely ground ore, typically in the presence of frothing or foaming agent. A chief advantage of separation by froth flotation is that it is a relatively efficient operation at a substantially lower cost than many other processes.

A wide variety of compounds are taught to be useful in froth flotation e.g. as collectors, frothers, modifiers, depressants, dispersants, pH regulators, and various promoters and additives; e.g. see "Reagents for Better Metallurgy," edited by P. S. Mulukutla, published by the Society for Mining, Metallurgy and Exploration, Inc, 1994. A single compound may perform more than one function. The specific additives used in a particular flotation operation are usually selected according to the nature of the ore, the conditions under which the flotation will take place, the mineral sought to be recovered and the other additives which are to be used in combination therewith.

The use of various collectors e.g. for ore beneficiation is disclosed in U.S. Pat. Nos. 4,556,482; 4,595,493; 4,587,013; 4,511,464; 4,605,519; 4,618,461; 4,676,890; 4,684,459; 4,699,711; 4,702,822; 4,732,668; 4,735,711; 4,780,557; 4,789,392; 4,797,202; 4,793,852; and 4,822,483. Alkylated diaryl oxide monosulfonate collectors are disclosed in U.S. Pat. No. 5,015,367.Dialkyl aryl monosulfonate collectors are disclosed in U.S. Pat. No. 5,173,176. A phosphate flotation process employing various aryl disulfonates is disclosed in U.S. Pat. No. 4,172,029. Depressants for silica or siliceous gangue are disclosed in U.S. Pat. No. 5,057,209. Both depressants and collectors may be combinations of substances as in U.S. Pat. Nos. 4,514,292; 4,309,282; and 5,171,427. The use of sulfonates as a substitute for, or along with, xanthate or dithiophosphate in copper sulfide ore flotation is disclosed in U.S. Pat. No. 3,827,557. An apatite flotation process employing combinations which include alkyl aryl sulfonate is disclosed in U.S. Pat. No. 3,405,802. Flotation of heavy metal oxides is disclosed in U.S. Pat. No. 2,861,687. Aryl sulfonates useful as depressants for froth flotation of micaceous minerals are disclosed in U.S. Pat. No. 3,214,018. Use of dinonyl naphthalene disulfonic acid in solvent extraction of metals is disclosed in U.S. Pat. No. 4,166,837 and U.S. Pat. No. 4,255,395. All patents, patent applications, books and articles mentioned herein are hereby incorporated herein by reference.

Despite the large number of compounds and combinations of compounds, those skilled in the art are constantly searching for new ways to improve ore beneficiation. Frequently, froth flotation is a very large-scale operation, so that beneficiation improvements of 0.5% or 1% may provide dramatic increases in plant economics. Accordingly, it is an object of the instant invention to provide new compositions, effective to provide improved beneficiation of a particulate sulfide or precious metal ore in a froth flotation process. It is another object to provide methods of using new compositions, effective to provide improved beneficiation of a particulate sulfide or precious metal ore in a froth flotation process.

SUMMARY OF THE INVENTION

In accordance with these and other objects, the present invention provides, in one embodiment, a composition comprised of (a) a dialkyl aryl disulfonic acid selected from the group consisting of dialkyl naphthalene disulfonic acid, dialkyl benzene disulfonic acid, dialkyl diphenyloxide disulfonic acid, and dialkyl biphenyl disulfonic acid; and (b) a collector selected from the group consisting of dialkyl dithiophosphinates, diaryl dithiophosphinates, dialkyl monothiophosphinates, diaryl monothiophosphinates, dialkylthionocarbamates, allyl alkyl thionocarbamates, hydrocarboxycarbonyl thionocarbamates, hydrocarboxycarbonyl thioureas, dialkyldithiophosphates, diaryldithiophosphates, dialkylmonothiophosphates, diarylmonothiophosphates, mercaptobenzothiazoles, alkyl xanthates, alkyl xanthate esters, alkyl xanthogen formates, alkyl dithiocarbamates, dialkyl sulfides, alkyl trithiocarbonates, dialkyl trithiocarbonates, cyanoethyl alkyl sulfides, alkyl thioethylamines, and mixtures and salts thereof; wherein the amounts of said (a) and said (b) are effective to provide improved beneficiation of a particulate sulfide or precious metal ore in a froth flotation process. In preferred embodiments, said dialkyl aryl disulfonic acid is a collector, and preferably contains about 16 or more carbon atoms, more preferably from about 22 to about 34 carbon atoms. Even more preferably, said dialkyl aryl disulfonic acid is a dialkyl naphthalene disulfonic acid, most preferably dinonyl naphthalene disulfonic acid (DNNDSA). Preferably, said composition contains less than 50%, more preferably less than 20%, of dialkyl aryl monosulfonic acid, by weight based on dialkyl aryl disulfonic acid. Preferably, the collector is selected from the group consisting of hydrocarboxycarbonyl thionocarbamates, hydrocarboxycarbonyl thioureas, dialkyldithiophosphates, dialkylmonothiophosphates, dialkyl dithiophosphinates, dialkylthionocarbamates, mercaptobenzothiazoles, and salts and mixtures thereof; most preferably, the collector is selected from the group consisting of diisobutyidithiophosphate and diisobutylmonothiophosphate. Preferably, said composition further comprises a second collector different from said (a) or said (b). Preferably, the ore is a particulate sulfide ore.

The present invention also provides, in another embodiment, a process comprising: (I) forming an aqueous slurry comprised of (a) particulate sulfide or precious metal ore and (b) a composition comprised of (i) a dialkyl aryl disulfonic acid selected from the group consisting of dialkyl naphthalene disulfonic acid, dialkyl benzene disulfonic acid, dialkyl diphenyloxide disulfonic acid, and dialkyl biphenyl disulfonic acid; and (ii) a collector different from said (i); and (II) collecting beneficiated minerals by subjecting said slurry to froth flotation conditions; wherein the amounts of said (i) and said (ii) are effective to provide improved beneficiation of said particulate sulfide or precious metal ore. In preferred embodiments, said dialkyl aryl disulfonic acid is a collector, and preferably contains about 14 or more carbon atoms, more preferably from about 22 to about 34 carbon atoms. Even more preferably, said dialkyl aryl disulfonic acid is a dialkyl naphthalene disulfonic acid, most preferably dinonyl naphthalene disulfonic acid (DNNDSA). Preferably, said composition contains less than 50%, more preferably less than 20%, of dialkyl aryl monosulfonic acid, by weight based on dialkyl aryl disulfonic acid. Preferably, the collector is selected from the group consisting of dialkyl dithiophosphinates, diaryl dithiophosphinates, dialkyl monothiophosphinates, diaryl monothiophosphinates, dialkylthionocarbamates, allyl alkyl thionocarbamates, hydrocarboxycarbonyl thionocarbamates, hydrocarboxycarbonyl thioureas, dialkyldithiophosphates, diaryldithiophosphates, dialkylmonothiophosphates, diarylmonothiophosphates, mercaptobenzothiazoles, alkyl xanthates, alkyl xanthate esters, alkyl xanthogen formates, and mixtures and salts thereof; more preferably, the collector is selected from the group consisting of rbonyl thionocarbamates, hydrocarboxycarbonyl thioureas, dialkyldithiophosphates, dialkylmonothiophosphates, dialkyl dithiophosphinates, dialkylthionocarbamates, mercaptobenzothiazoles, and salts and mixtures thereof; most preferably, the collector is selected from the group consisting of diisobutyldithiophosphate and diisobutylmonothiophosphate. Preferably, said composition further comprises a second collector different from said (i) or said (ii). Preferably, the ore is a particulate sulfide ore.

DETAILED DESCRIPTION OF THE INVENTION

Sulfide and/or precious metal ores which may be beneficiated by the practice of the instant invention include well-known sulfide or precious metal ores e.g. ores containing precious metals such as platinum, palladium, gold, silver, rhodium, iridium, rhenium, etc. and minerals containing these precious metals. Chalcopyrite, covellite, bornite, energite, argentite, millerite, cobaltite, arsenopyrite, stibnite, orpiment, realgar, cinnabar, alabandite, chalcocite, galena, pyrite, sphalerite, molybdenite, and pentlandite are representative minerals that may be contained in sulfide ores.

Particulate sulfide or precious metal ores are generally formed by e.g. crushing or grinding larger ore fragments to provide particulate sulfide or precious metal ores of flotation size by means well known to those skilled in the art. The particle size of the particulate sulfide or precious metal ore will tend to vary from ore to ore and may depend on several factors e.g. the nature of the deposit and liberation characteristics. In general, particulate sulfide or precious metal ores should be predominately finer than about 50 mesh, preferably in the range of about 50 mesh to about 400 mesh sizes, most preferably from about 65 mesh to about 200 mesh. An aqueous slurry of particulate sulfide or precious metal ores may be formed by intermixing the particulate sulfide or precious metal ore with water or other aqueous media in the usual manner. Frequently, the aqueous slurry contains other compounds useful in froth flotation as described herein. The aqueous slurry typically contains from about 10% to about 60%, preferably about 25 to about 50%, most preferably about 30% to about 40%, of ore solids, by weight based on total weight. Unless otherwise indicated, all percentages mentioned herein are on a weight basis, based on total weight.

The particulate sulfide or precious metal ore may be slurried with a composition comprised of a dialkyl aryl disulfonic acid and a collector different from the dialkyl aryl disulfonic acid. The dialkyl aryl disulfonic acid of the instant invention may contain any aryl group, preferably diphenyloxide, anthracene, benzene, naphthalene, phenol, and biphenyl, more preferably benzene, naphthalene, and biphenyl; most preferably naphthalene. The aryl group generally has two alkyl substituents and two sulfonic acid, or sulfonate, substituents. As used herein "sulfonic acid" includes the sulfonate i.e. salt form of the acid. One, both or neither of the sulfonic acid substituents on an aryl group may be in the sulfonate form. For instance, in the representative structures of dialkyl aryl disulfonic acids shown below, the counterions to the $SO_3^-$ groups may be H or known metal ions, e.g. $Na^+$, $K^+$, etc.:

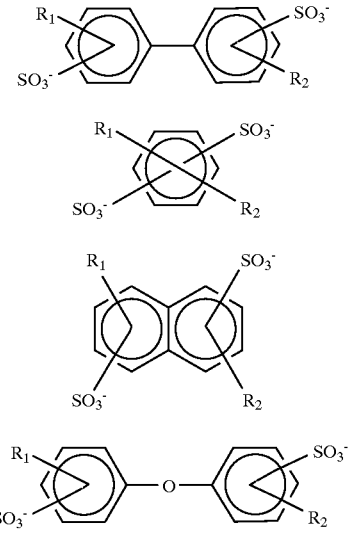

The alkyl substituents e.g. $R_1$ and $R_2$, may be any alkyl or branched alkyl group; preferably each alkyl group contains from 1 to about 16 carbons, more preferably about 4 to about 12 carbons. The two alkyl substituents on each aryl group may be the same or different. When the aryl group contains two or more aromatic rings, the alkyl groups may be on the same ring or different rings. Also, when the aryl group contains two or more aromatic rings, the sulfonic acid groups may be on the same ring or different rings. The dialkyl aryl disulfonic acid generally contains about 8 or more carbon atoms, preferably about 10 or more, more preferably about 14 or more, even more preferably about 16 or more, most preferably about 22 or more. The dialkyl aryl disulfonic acid generally contains about 46 or less carbon atoms, preferably about 34 or less, most preferably 28 or less. Preferably, the dialkyl aryl disulfonic acid is a collector. A most preferred dialkyl aryl disulfonic acid is dinonyl naphthalene disulfonic acid (DNNDSA). Dialkyl aryl disulfonic acid may be obtained commercially or may be prepared by methods known to those skilled in the art e.g. U.S. Pat. No. 4,943,656. Generally, dialkyl aryl monosulfonic acids, monoalkyl aryl disulfonic acids, and non-aryl sulfonic acids are less effective than the dialkyl aryl disulfonic acids. For instance, lignin sulfonates, petroleum sulfonates, and monoalkyl aryl monosulfonic acids do not generally show the advantages of the instant invention. Accordingly, the compositions of the instant invention, comprised of a dialkyl aryl disulfonic acid and a collector different from the dialkyl aryl disulfonic acid, generally contain less than 50% of dialkyl aryl monosulfonic acid, preferably less than 20%, by weight based on dialkyl aryl disulfonic acid. Also, the compositions of the instant invention, comprised of a dialkyl aryl disulfonic acid and a collector different from the dialkyl aryl disulfonic acid, generally contain less than 50% of monoalkyl aryl disulfonic acid, preferably less than 20%, by weight based on dialkyl aryl disulfonic acid.

Collectors, different from the dialkyl aryl disulfonic acid, may be any collector or combination of collectors known to those skilled in the art. Collectors enumerated in the aforementioned patents and methods for making those collectors are hereby incorporated herein by reference. Preferably, the collectors are sulfide collectors. Useful collectors include alkyl mercaptans, thiocarbanilides, dialkyl disulfides, aryl hydrocarbons, alkyl hydrocarbons, 1,3-oxathiolane-2-thiones, 1,3-dithiolane-2-thiones, O- and S-(2-mercaptoalkyl)-mono- or dihydrocarbyl carbamodithioates, substituted mercaptobenzothiazoles, mercaptobenzoxazoles, substituted mercaptobenzoxazoles, O,O'-, O,S'-, and S,S'-dithiodialkylene-bis(mono- or dihydrocarbyl) carbamothioates, omega-(hydrocarbylthio)alkylamines, S-(omega-aminoalkyl)hydrocarbyl thioate, N-(hydrocarbyl) alpha, omega-alkanediamines, N-(omega-aminoalkyl) hydrocarbon amides, omega(hydrocarbyloxy)alkylamines, omega-aminoalkyl hydrocarbonates, and epithiocompounds, alkylamines, alkyl sulfates, alkyl sulfonates, carboxylic acids, fatty acids, and mixtures and salts thereof. Preferred collectors include dialkyl dithiophosphinates, diaryl dithiophosphinates, dialkyl monothiophosphinates, diaryl monothiophosphinates, dialkylthionocarbamates, allyl alkyl thionocarbamates, hydrocarboxycarbonyl thionocarbamates, hydrocarboxycarbonyl thioureas, dialkyldithiophosphates, diaryldithiophosphates, dialkylmonothiophosphates, diarylmonothiophosphates, mercaptobenzothiazoles, alkyl xanthates, alkyl xanthate esters, alkyl xanthogen formates, xanthates, alkyl dithiocarbamates, dialkyl sulfides, alkyl trithiocarbonates, dialkyl trithiocarbonates, cyanoethyl alkyl sulfides, alkyl thioethylamines, and mixtures and salts thereof. More preferred collectors include hydrocarboxycarbonyl thionocarbamates, hydrocarboxycarbonyl thioureas, dialkyldithiophosphates, dialkylmonothiophosphates, dialkyl dithiophosphinates, dialkylthionocarbamates, mercaptobenzothiazoles, and mixtures and salts thereof. Most preferred collectors are dialkyldithiophosphate and dialkylmonothiophosphate, particularly diisobutyldithiophosphate and diisobutylmonothiophosphate.

A feature of the instant invention is that a composition comprised of a dialkyl aryl disulfonic acid and a collector different from the dialkyl aryl disultonic acid may be prepared prior to using the composition for beneficiation. In some cases it may be advantageous to prepare the composition at the production site by combining a dialkyl aryl disulfonic acid and a collector different from the dialkyl aryl disulfonic acid, or by intermixing a dialkyl aryl disulfonic acid and a collector different from the dialkyl aryl disulfonic acid with particulate sulfide or precious metal ore, in any order, in order to respond to the vagaries of production by adjusting the amounts of each component of the composition. In other cases, however, the need for on-site mixing equipment and the concomitant potential for batch-to-batch variation may be undesirable. Consequently, it is an advantage of the instant invention that a composition comprised of a dialkyl aryl disulfonic acid and a collector different from the dialkyl aryl disulfonic acid may be provided so that the need for on-site mixing or metering is eliminated. In some cases, it may be preferred for the composition to also comprise water, alcohol, pH adjuster, etc. to improve handling, shelf life, etc. of the composition.

A feature of the instant invention is that the novel compositions may be single phase mixtures, e.g. aqueous solutions, or may be single phase mixtures when a small amount of a solvent e.g. alcohol is added. An advantage is obtained from the use of single phase mixtures because they are generally preferred for handling purposes. Another feature of the instant invention is that the instant compositions may be used in a wide pH range, unlike some other known collectors. Generally, the instant invention may be practiced at any pH, depending on the nature of the ore and the collector. An advantage is obtained from a wide pH operability range because less pH adjustment may be needed, thus saving costs and reducing inconvenience. Another feature of the instant invention is that generally no specialized equipment or process changes are required in order to practice the instant invention in operating flotation plants, which may also give the advantage of saving costs and reducing inconvenience. Another feature of the instant invention is that reduced frother usage may result from the practice of the instant invention, which may also give the advantage of saving costs and reducing inconvenience.

Beneficiation of particulate sulfide or precious metal ores may be practiced by forming an aqueous slurry comprised of particulate sulfide or precious metal ore and a composition comprised of a dialkyl aryl disulfonic acid and a collector different from said dialkyl aryl disulfonic acid by e.g. intermixing the particulate sulfide ore with said composition, or by forming the composition in situ by intermixing particulate sulfide ore, dialkyl aryl disulfonic acid, and collector in any order. The aqueous slurry, comprised of particulate sulfide or precious metal ore and a composition comprised of a dialkyl aryl disulfonic acid and a collector different from said dialkyl aryl disulfonic acid, may be formed at any point in the process e.g. in the grinding mill, after the grinding mill, before size separation e.g. cyclone, after size separation, in the flotation machine, etc., or may be formed in stages as discussed below. Preferably, two or more collectors are used, either simultaneously or in any order. For instance, the composition may be comprised of a dialkyl aryl disulfonic acid, a first collector different from the dialkyl aryl disulfonic acid, and a second collector different from said first or second collectors; said composition may also be formed in situ as above. Obviously, when the dialkyl aryl disulfonic acid is itself a collector, the other two collectors may be termed second and third collectors, respectively. The additional collector, if any, should also be used in an amount effective to provide improved beneficiation of said particulate sulfide or precious metal ore. Other compounds useful in froth flotation e.g. collectors, frothers, modifiers, depressants, dispersants, pH regulators, promoters, additives etc. may also be added to the aqueous slurry. Beneficiated minerals are generally collected by subjecting the aqueous slurry to froth flotation conditions. The process per se of collecting beneficiated minerals by froth flotation is generally known to those skilled in the art; see e.g. "Flotation: Theory, Reagents and Ore Testing" by Ronald D. Crozier, Pergammon Press 1992.

The instant invention may be practiced by adding the instant compositions, comprised of dialkyl aryl disulfonic acid and collector different from said dialkyl aryl disulfonic acid, to particulate sulfide or precious metal ore in a single addition step or by staged addition. By staged addition, it is meant that a part of the effective amount of the composition is added to the aqueous slurry of particulate sulfide or precious metal ore; froth concentrate is collected; an additional portion of the composition is added; froth concentrate is again collected, and so on. This staged addition may be repeated several times to obtain optimum recovery. The number of stages is generally limited, in practice, by practical and economic restraints. Staged addition may also be carried out by adding a particular composition of the instant invention at one stage, and a collector or a different composition of the instant invention at another stage.

The amounts of dialkyl aryl disulfonic acid and collector different from said dialkyl aryl disulfonic acid used in the processes and compositions of the instant invention are effective to provide improved beneficiation of particulate sulfide or precious metal ore. Effective amounts of dialkyl aryl disulfonic acid and collector different from said dialkyl aryl disulfonic acid may generally be found by routine experimentation. Improved beneficiation may be evidenced by improved recovery e.g. when higher % recovery of value minerals is obtained using the instant invention than when the instant invention is not practiced. Specific examples of improved beneficiation are demonstrated in the Examples below. Generally, for compositions comprised of (a) dialkyl aryl disulfonic acid and (b) collector different from said dialkyl aryl disulfonic acid, the weight ratio of (a) to (b) is in the range of about 5:95 to about 95:5. Preferably, the composition contains less (a) than (b), and most preferably the ratio of (a) to (b) is in the range of about 5:95 to about 45:55. Typical amounts of dialkyl aryl disulfonic acid effective to provide improved beneficiation may range from about 0.5 to about 100 grams per ton of dry ore (g/t), preferably about 5 to about 50 g/t, same basis. Typical amounts of collector, different from said dialkyl aryl disulfonic acid, effective to provide improved beneficiation may range from about 1 to about 400 g/t, preferably about 5 to about 100 g/t, same basis.

Other objects and advantages provided by the compositions and processes of the instant invention will become apparent from the following working Examples, which are provided by way of further illustration only, to enable those skilled the art to better understand and practice the instant invention.

The following abbreviations may be used in the Examples:

SIPX Sodium Isopropy xanthate
SIBX Sodium isobutyl xanthate
IPETC Isopropyl ethyl thionocarbamate
EIXF Ethyl isopropyl xanthogen formate
ESBDTP 50% solution of ethyl sec-butyl dithiophosphate in water
DIBDTP 50% solution of diisobutyl dithiophosphate in water
DIBMTP 50% solution of diisobutylmonothiophosphate in water
ECIBTC 75% solution of ethoxycarbonyl isobutyl thionocarbamate in isobutanol
ECHTC 75% solution of ethoxycarbonyl hexyl thionocarbamate in isobutanol
MIBC Methyl isobutyl carbinol
MBT 50% solution of the sodium salt of mercaptobenzothiazole in water
DNNDSA 40% solution of dinonyl napthalene disulfonic acid (about 35%) and residual byproducts (about 5%, primarily mononnonyl naphthalene monosulfonic acid and dinonyl naphthalene monosulfonic acid) in isobutanol All percentages herein are by weight, based on total weight, unless otherwise indicated. SIPX, SIBX, IPETC, EIXF, ESBDTP, DIBDTP, DIBMTP, ECIBTC, ECHTC, MIBC and MBT may be obtained commercially. The DNNDSA solution is commercially available from Cytec Industries, Inc. as Cycat® 500. Polypropylene glycol-based (PPG-based) frothers used in the Examples are those typically used in froth flotation and are commercially available.

In the following Examples, compositions V, W, X, Y and Z are embodiments of the instant invention. Composition V was obtained by intermixing 88 parts of ESBDTP collector with 12 parts of DNNDSA. Composition W was obtained by intermixing 88 parts of ECIBTC collector with 12 parts of DNNDSA. Composition X was obtained by intermixing 80 parts of DIBDTP collector with 20 parts DNNDSA. Composition Y was obtained by intermixing 70 parts of DIBDTP collector, 20 parts of DNNDSA, and 10 parts of methanol. Composition Z was obtained by intermixing 70 parts of DIBMTP collector, 20 parts of DNNDSA, and 10 parts of methanol. Minor amounts of NaOH solution were added to each composition to adjust pH to about 10.5.

Amounts of compositions V, W, X, Y and Z, as well as amounts of collector and frother, are given in the following Examples in units of grams per ton of dry ore (g/t).

EXAMPLES 1–4

One kilogram (kg) of a sulfide ore with a feed assay of 2.74% copper was ground in a steel ball mill at about 50% solids to obtain a slurry with a granulometry of 27%+100 mesh. Lime was added to the grinding mill to adjust the pH of the slurry. For each run, a collector from Table 1 was added at the dose shown to either the mill or to the flotation machine after the slurry had been transferred thereto. The volume in the flotation machine was adjusted to obtain a slurry of about 27% solids. The pH of the slurry was about 10. Collector SIBX at about 20 g/t and PPG-based frother at about 60 g/t were then added to the slurry and conditioned for about 1 to 2 minutes. Air was passed through the flotation machine and beneficiated minerals were collected by froth flotation for about 12 minutes. The beneficiated minerals were assayed for value metals such as Cu. The results shown in Table 1 demonstrate the amounts of composition X (DNNDSA and DIBDTP), as well as composition Y (DNNDSA and DIBDTP), that are effective to provide improved beneficiation of sulfide ore, as measured by the % Cu assay of the beneficiated minerals.

TABLE 1

| Example # | Collector | Dosage, g/t | Grade % Cu | Assay, % Cu |
|---|---|---|---|---|
| 1C | IPETC/MIBC | 40 | 13.2 | 61.1 |
| 2 | Comp. X | 40 | 10.3 | 78.4 |
| 3 | Comp. Y | 40 | 8.9 | 88.8 |
| 4C | DIBDTP/ ECIBTC | 40 | 12.9 | 63.8 |

DIBDTP/ECIBTC: 70 parts DIBDTP, 30 parts ECIBTC and 10 parts 2-ethyl hexanol
IPETC/MIBC: 50 parts IPETC, 50 parts MIBC
C: Comparative

EXAMPLES 5–6

Four liters of an aqueous slurry containing approximately 1670 grams of sulfide ore with a feed assay of 1.12% Cu was added to a flotation cell. The granulometry of this slurry was 23%+65 mesh at 33% solids. The pH of this slurry was adjusted to about 11 using lime. For each run, a collector from Table 2 was added at the dose shown along with collector SIBX at 12 g/t. A frother mixture containing PPG-based frother and MIBC (1:4 ratio) at about 18 g/t was added to the slurry and conditioned for about 1 to 2 minutes. Air was passed through the flotation machine and beneficiated minerals were collected by froth flotation for about 6 minutes. The beneficiated minerals were assayed for value metals such as Cu. The results shown in Table 2 demonstrate the amounts of composition X (DNNDSA and DIBDTP) that are effective to provide improved beneficiation of sulfide ore, as measured by the % Cu assay of the beneficiated minerals.

TABLE 2

| Example # | Collector | Dosage g/t | Grade % Cu | Assay, % Cu |
|---|---|---|---|---|
| 5C | DIBDTP | 12 | 11.4 | 89.4 |
| 6 | Comp. X | 12 | 10.4 | 90.3 |

C: Comparative

EXAMPLES 7–9

About 1.19 kg of a sulfide ore with a feed assay of 1.18% copper was ground in a steel ball mill at about 73% solids to obtain a slurry with a granulometry of 28%+65 mesh. Lime was added to the grinding mill to adjust the pH of the slurry. For each run, the collector combination from Table 3 was added to the mill at the total dose shown; the doses of the individual collectors in each combination are shown in parentheses. The aqueous slurry was transferred to the flotation machine and the volume was adjusted to obtain a slurry of about 37% solids. The pH of the slurry was about 10.5. Frother mixture PPG-based frother/MIBC/pine oil (4/2/1 proportions) at about 20 g/t was then added to the slurry and conditioned for about 1 to 2 minutes. Air was passed through the flotation machine and beneficiated minerals were collected by froth flotation for about 9 minutes. The beneficiated minerals were assayed for value metals such as Cu. The results shown in Table 3 demonstrate the amounts of composition Z (DNNDSA and DIBMTP) that are effective to provide improved beneficiation of sulfide ore, as measured by the % Cu assay of the beneficiated minerals.

TABLE 3

| Example # | Collector (dose, g/t) | Total Dosage, g/t | Grade, % Cu | Assay, % Cu |
|---|---|---|---|---|
| 7 | Comp. Z (20)<br>SIPX (15) | 35 | 10.4 | 90.3 |
| 8C | DIBDTP/<br>ECIBTC (20)<br>SIPX (15) | 35 | 19 | 81.4 |
| 9C | DIBDTP/<br>MBT (3)<br>SIPX (32) | 35 | 17.9 | 81.0 |

DIBDTP/ECIBTC: 70 parts DIBDTP, 30 parts ECIBTC and 10 parts 2-ethyl hexanol
DIBDTP/MBT: 90 parts DIBDTP, 10 parts MBT
C: Comparative

EXAMPLES 10–11

About 1 kg of a sulfide ore with a feed assay of 1.16% copper was ground in a steel ball mill at about 67% solids to obtain a slurry with a granulometry of 25%+65 mesh. Lime was added to the grinding mill to adjust the pH of the slurry. For each run, a collector from Table 4 was added at the dose shown to the mill along with collector mixture DIBDTP/ECHTC (70/30 by weight) at about 18 g/t. The aqueous slurry was transferred to the flotation machine and the volume was adjusted to obtain a slurry of about 37% solids. The pH of the slurry was about 11. PPG-based frother at about 60 g/t was then added to the slurry and conditioned for about 1 to 2 minutes. Air was passed through the flotation machine and beneficiated minerals were collected by froth flotation for about 7 minutes.

The beneficiated minerals were assayed for value metals such as Cu. The results shown in Table 4 demonstrate the amounts of composition Z (DNNDSA and DIBMTP) that are effective to provide improved beneficiation of sulfide ore, as measured by the % Cu assay of the beneficiated minerals.

TABLE 4

| Example # | Collector | Dosage g/t | Grade % Cu | Assay, % Cu |
|---|---|---|---|---|
| 10C | EIXF | 18 | 15.3 | 85.8 |
| 11 | Comp. Z | 18 | 12.8 | 87.2 |

C: Comparative

EXAMPLES 12–14

2.47 kg of a sulfide ore with a feed assay of 0.9% copper was ground in a steel ball mill at about 62% solids to obtain a slurry with a granulometry of 23%+65 mesh. Lime was added to the grinding mill to adjust the pH of the slurry. For each run, a collector mixture from Table 5 was added at the dose shown to either the mill or to the flotation machine after the slurry had been transferred thereto. The volume in the flotation machine was adjusted to obtain a slurry of about 35% solids. The pH of the slurry was about 11. Collector SIPX at the dose shown in Table 5 and frother mixture PPG-based frother/MIBC (1/1) at about 20 g/t were then added to the slurry and conditioned for about 1 to 2 minutes. Air was passed through the flotation machine and beneficiated minerals were collected by froth flotation for about 8 minutes. The beneficiated minerals were assayed for value metals such as Cu. The results shown in Table 5 demonstrate the amounts of composition X (DNNDSA and DIBDTP) and SIPX that are effective to provide improved beneficiation of sulfide ore, even at lower total dose, as measured by the % Cu assay of the beneficiated minerals.

TABLE 5

| Example # | Collector (dose, g/t) | Total Dosage, g/t | Grade, % Cu | Assay, % Cu |
|---|---|---|---|---|
| 12C | IPETC (10)<br>SIPX (28) | 38 | 4.1 | 72.2 |
| 13 | Comp. X (20)<br>SIPX (15) | 35 | 3.1 | 80.6 |
| 14C | DIBDTP/<br>ECIBTC (10)<br>SIPX (28) | 38 | 3.8 | 75.2 |

DIBDTP/ECIBTC: 70 parts DIBDTP, 30 parts ECIBTC and 10 parts 2-ethyl hexanol
C: Comparative

EXAMPLE 15 (COMPARATIVE)

A blend was prepared by intermixing 80 parts of DIBDTP and 20 parts of 40% aqueous para-toluenesulfonic acid. An attempt was made to beneficiate ore by the general procedure of Examples 1–4, using said blend at 40 g/t in the place of the composition of the instant invention, and using collector SIPX at 20 g/t in the place of collector SIBX. Improved beneficiation was not obtained. This Example demonstrates that para-toluenesulfonic acid, a monoalkyl aryl monosulfonic acid, does not provide improved beneficiation under these conditions.

EXAMPLES 16–18

One kilogram (kg) of a sulfide ore with a feed assay of 2.5% copper was ground in a steel ball mill at about 50% solids to obtain a slurry with a granulometry of 27%+100 mesh. Lime was added to the grinding mill to adjust the pH of the slurry. For each run, a collector from Table 6 was added at the dose shown to either the mill or to the flotation machine after the slurry had been transferred thereto. The volume in the flotation machine was adjusted to obtain a slurry of about 27% solids. The pH of the slurry was about 10. Collector SIBX at about 10 g/t and PPG-based frother at about 60 g/t were then added to the slurry and conditioned for about 1 to 2 minutes. Air was passed through the flotation machine and beneficiated minerals were collected by froth flotation for about 12 minutes. The beneficiated minerals were assayed for value metals such as Cu. The results shown in Table 6 demonstrate the amounts of composition X (DNNDSA and DIBDTP) that are effective to provide improved beneficiation of sulfide ore, as measured by the % Cu assay of the beneficiated minerals.

TABLE 6

| Example # | Collector | Dosage, g/t | Grade % Cu | Assay, % Cu |
|---|---|---|---|---|
| 16C | IPETC/MIBC | 40 | 15.25 | 80.63 |
| 17 | Comp. X | 40 | 7.7 | 83.4 |
| 18 | DIBDTP/ ECIBTC | 9 | 7.1 | 86.4 |
| | Comp. X | 31 | | |

DIBDTP/ECIBTC: 70 parts DIBDTP, 30 parts ECIBTC and 10 parts 2-ethyl hexanol
IPETC/MIBC: 50 parts IPETC, 50 parts MIBC
C: Comparative

EXAMPLES 19–22

One kilogram (kg) of a sulfide ore with a feed assay of 2.5% copper was ground in a steel ball mill at about 50% solids to obtain a slurry with a granulometry of 27%+100 mesh. Lime was added to the grinding mill to adjust the pH of the slurry. For each run, a collector from Table 7 was added at the dose shown to the flotation machine after the slurry had been transferred thereto. The volume in the flotation machine was adjusted to obtain a slurry of about 27% solids. The pH of the slurry was about 10. PPG-based frother at about 60 g/t was then added to the slurry and conditioned for about 1 to 2 minutes. Air was passed through the flotation machine and beneficiated minerals were collected by froth flotation for about 12 minutes. The beneficiated minerals were assayed for value metals such as Cu. The results shown in Table 7 demonstrate the amounts of DNNDSA and other collector that are effective to provide improved beneficiation of sulfide ore, as measured by the % Cu assay of the beneficiated minerals.

TABLE 7

| Example # | Collector | Dosage, g/t | Grade % Cu | Assay, % Cu |
|---|---|---|---|---|
| 19C | EIXF | 40 | 14.3 | 79.6 |
| 20 | Comp. V | 30 | 13.1 | 81.03 |
| 21 | Comp. W | 30 | 14.2 | 85.2 |
| 22C | ESBDTP | 30 | 13.1 | 74.7 |

C: Comparative

We claim:

1. A process comprising (I) forming an aqueous slurry comprised of (a) particulate sulfide or precious metal ore and (b) a composition comprised of (i) a dialkyl aryl disulfonic acid selected from the group consisting of dialkyl naphthalene disulfonic acid, dialkyl benzene disulfonic acid, dialkyl diphenyloxide disulfonic acid, and dialkyl biphenyl disulfonic acid; and (ii) a collector selected from the group consisting of dialkyl dithiophosphinates, diaryl dithiophosphinates, dialkyl monothiophosphinates, diaryl monothiophosphinates, dialkylthionocarbamates, allyl alkyl thionocarbamates, hydrocarboxycarbonyl thionocarbamates, hydrocarboxycarbonyl thioureas, dialkyldithiophosphates, diaryldithiophosphates, dialkylmonothiophosphates, diarylmonothiophosphates, mercaptobenzothiazoles, alkyl xanthates, alkyl xanthate esters, alkyl xanthogen formates, and mixtures and salts thereof; and (II) collecting beneficiated minerals by subjecting said slurry to froth flotation conditions;

wherein the amounts of said (i) and said (ii) are effective to provide improved beneficiation of said particulate sulfide or precious metal ore, and wherein said composition contains less than 20% of dialkyl aryl monosulfonic acid, by weight based on said dialkyl aryl disulfonic acid.

2. A process as claimed in claim 1, wherein said dialkyl aryl disulfonic acid contains at least about 14 carbon atoms.

3. A process as claimed in claim 1 wherein said dialkyl aryl disulfonic acid is a collector.

4. A process as claimed in claim 1 wherein said composition further comprises a second collector different from said (i) or said (ii) in an amount effective to provide improved beneficiation of said particulate sulfide or precious metal ore.

5. A process as claimed in claim 1 wherein said dialkyl aryl disulfonic acid is dialkyl naphthalene disulfonic acid.

6. A process comprising (I) forming an aqueous slurry comprised of (a) particulate sulfide ore and (b) a composition comprised of (i) a dialkyl naphthalene disulfonic acid and (ii) a collector selected from the group consisting of hydrocarboxycarbonyl thionocarbamates, hydrocarboxycarbonyl thioureas, dialkyldithiophosphates, dialkylmonothiophosphates, dialkyl dithiophosphinates, dialkylthionocarbamates, mercaptobenzothiazoles, and salts and mixtures thereof; and (II) collecting beneficiated minerals by subjecting said slurry to froth flotation conditions;

wherein the amounts of said (i) and said (ii) are effective to provide improved beneficiation of said particulate sulfide ore, and wherein said composition contains less than 20% of dialkyl aryl monosulfonic acid, by weight based on said dialkyl aryl disulfonic acid.

7. A process as claimed in claim 6 wherein said dialkyl naphthalene disulfonic acid is dinonyl naphthalene disulfonic acid.

8. A process as claimed in claim 7 wherein said collector is selected from the group consisting of diisobutyldithiophosphate and diisobutylmonothiophosphate.

9. A composition comprised of (a) a dialkyl aryl disulfonic acid selected from the group consisting of dialkyl naphthalene disulfonic acid, dialkyl benzene disulfonic acid, dialkyl diphenyloxide disulfonic acid, and dialkyl biphenyl disulfonic acid; and (b) a collector selected from the group consisting of dialkyl dithiophosphinates, diary dithiophosphinates, dialkyl monothiophosphinates, diaryl monothiophosphinates, dialkylthionocarbamates, allyl alkyl thionocarbamates, hydrocarboxycarbonyl thionocarbamates, hydrocarboxycarbonyl thioureas, dialkyldithiophosphates, diaryldithiophosphates, dialkylmonothiophosphates, diarylmonothiophosphates, mercaptobenzothiazoles, alkyl xanthates, alkyl xanthate esters, alkyl xanthogen formates, and mixtures and salts thereof;

wherein the amounts of said (a) and said (b) are effective to provide improved beneficiation of a particulate sulfide or precious metal ore in a froth flotation process, and wherein said composition contains less than 20% of dialkyl aryl monosulfonic acid, by weight based on said dialkyl aryl disulfonic acid.

10. A composition as claimed in claim 9 wherein said dialkyl aryl disulfonic acid contains about 16 or more carbon atoms.

11. A composition as claimed in claim 9 wherein said dialkyl aryl disulfonic acid contains from about 22 to about 34 carbon atoms.

12. A composition as claimed in claim 9 wherein said dialkyl aryl disulfonic acid is dialkyl naphthalene disulfonic acid.

13. A composition as claimed in claim 9 wherein said dialkyl aryl disulfonic acid is dinonyl naphthalene disulfonic acid.

14. A composition as claimed in claim 9 which further comprises a second collector different from said (a) or said (b) in an amount effective to provide improved beneficiation of said particulate sulfide or precious metal ore.

15. A composition as claimed in claim 9 wherein said composition contains less than 20% of dialkyl aryl monosulfonic acid, by weight based on dialkyl aryl disulfonic acid.

16. A composition as claimed in claim 9 wherein said collector is selected from the group consisting of hydrocarboxycarbonyl thionocarbamates, hydrocarboxycarbonyl thioureas, dialkyldithiophosphates, dialkylmonothiophosphates, dialkyl dithiophosphinates, dialkylthionocarbamates, mercaptobenzothiazoles, and salts and mixtures thereof.

17. A composition as claimed in claim 9 wherein said collector is selected from the group consisting of diisobutyldithiophosphate and diisobutylmonothiophosphate.

18. A composition as claimed in claim 9 wherein said dialkyl aryl disulfonic acid is dinonyl naphthalene disulfonic acid and wherein said collector is selected from the group consisting of diisobutyldithiophosphate and diisobutylmonothiophosphate.

* * * * *